US005472322A

United States Patent [19]

Huet et al.

[11] Patent Number: 5,472,322

[45] Date of Patent: Dec. 5, 1995

[54] POSITIVE DISPLACEMENT VACUUM PUMP HAVING A PISTON ACTUATED BY AN ALTERNATIVE LINEAR MOVEMENT

[75] Inventors: Jean-Pierre Huet; Alain Courtois, both of Blois, France

[73] Assignee: Dubuis, Societe Anonyme, Blois, France

[21] Appl. No.: 281,084

[22] Filed: Jul. 27, 1994

[30] Foreign Application Priority Data

Jul. 30, 1993 [FR] France ..... 93 09395
Apr. 21, 1994 [FR] France ..... 94 04788

[51] Int. Cl.[6] ..... F04B 19/00

[52] U.S. Cl. ..... 417/415; 417/470; 92/136

[58] Field of Search ..... 417/470, 471, 417/415; 92/136

[56] References Cited

U.S. PATENT DOCUMENTS

| | | | |
|---|---|---|---|
| 1,929,935 | 10/1933 | Rennerfelt | 417/471 |
| 2,540,357 | 2/1951 | Stanley | 417/415 |
| 4,824,336 | 4/1989 | Iwaki | 417/415 |
| 5,028,217 | 7/1991 | Miller | 417/415 |
| 5,037,276 | 8/1991 | Tremoulet, Jr. | 417/470 |
| 5,253,981 | 10/1993 | Yang et al. | 417/415 |
| 5,355,920 | 10/1994 | Tanguay | 144/338 |

FOREIGN PATENT DOCUMENTS

| | | | |
|---|---|---|---|
| 1351516 | 12/1963 | France | 417/415 |
| 943985 | 6/1956 | Germany | 417/415 |
| 0123380 | 9/1980 | Japan | 417/415 |
| 0150082 | 9/1983 | Japan | 417/415 |
| 0150083 | 9/1983 | Japan | 417/415 |

*Primary Examiner*—Richard A. Berisch
*Assistant Examiner*—Peter G. Korytnyk
*Attorney, Agent, or Firm*—Sandler, Greenblum & Bernstein

[57] ABSTRACT

Positive displacement vacuum pump is provided with a pump body, and a piston is positioned in the pump body with the piston being mounted for actuation by alternative linear movement. An elastic element biases the piston in a first direction, and a cam acts on a first end of the piston, with the cam being rotatably movable along an axis that is coaxial with the longitudinal axis of the piston to drive the piston in an alternating linear movement. A transverse bar is positioned between a first end of the piston and the cam, and the transverse bar is rotatably fixed but translationally guided in the direction of alternative linear movement of the piston. Additionally, the cam comprises a double surface to equally bias the transverse bar at two positions along the length of the bar.

20 Claims, 2 Drawing Sheets

POSITIVE DISPLACEMENT VACUUM PUMP HAVING A PISTON ACTUATED BY AN ALTERNATIVE LINEAR MOVEMENT

BACKGROUND OF THE INVENTION

1. Field of the Invention

The invention is related to a positive displacement vacuum pump having a piston actuated by an alternative linear movement.

The invention is especially intended to constitute a motorized pump to displace a fluid towards the body of a hydraulic jack, for example, to activate tools such as crimping pliers, punch/clippers, etc.

2. Description of Background Information

Indeed, in these types of tools, pressure is exerted on a working member movably mounted in a head by means of a hydraulic jack activated by a lifting and forcing pump, for example as in the type of tools described in FR 8406346, published as FR-A-2,563,291.

Generally, the pumps utilized are controlled manually and the pump described in the aforementioned document is a positive displacement vacuum pump having a piston actuated by an alternative linear movement.

In order to ensure this alternative movement of the pump piston, the activation means are, for example, provided with operating handles but motor means, such as electric, can be envisioned also.

SUMMARY OF THE INVENTION

The object of the present invention is to provide a completely original activating system which is practical and compact.

Indeed, a pump according to the invention is characteristic in that the movement of the piston within the body of the pump is ensured by a cam which is driven in rotation along a coaxial axis at the longitudinal axis of the piston, and which acts on one of the ends of the piston, and the piston is permanently biased in the opposite direction by an elastic means.

Advantageously, the cam is provided with a handle/shank, itself rotationally driven.

As already mentioned, the invention is mainly intended to conceive a motorized pump, and it is therefore simple to provide a small electric motor supplied by accumulators or rechargeable batteries and/or by connection to the network, the motor being arranged to drive the cam.

According to a preferred but not mandatory embodiment, the end of the piston turned towards the cam is pressed on a transverse bar that is rotationally fixed but translationally guided in the direction of the movement of the piston, the bar resting on the cam, which is double, such that the latter, in combination with the elastic means, communicates to the bar and the piston an alternative rectilinear movement, such as by equally biasing the bar at two positions along its length.

According to one embodiment, the bar rests directly on the cam which slides by rotating the bar.

Preferably however, the bar rests on the cam by means of rollers with which it is equipped, such that the rollers rotate upon contact with the cam. In this case for example, the bar comprises two rollers arranged at its ends, and which are wedged by a spacer sleeve.

For a pump provided, in a known manner, with a deformable tank filled with liquid, the pump being intended to displace the liquid from the tank towards a utilization circuit, the deformable tank is annular, for example, and surrounds at least a portion of the pump body in which the piston is arranged.

According to a very interesting embodiment, the tank is constituted by a membrane whose impervious fixing/mounting is provided on the body or an integral portion thereof, so as to imperviously separate the hydraulic circuit from the mechanical portion comprising especially the bar, cam and corresponding end of the piston.

As already mentioned, a pump according to the invention is especially intended to activate a hydraulic jack, but it is clear that any known utilizations of pumps are possible.

BRIEF DESCRIPTION OF THE DRAWINGS

The invention will be better understood upon reading the following description with reference to the annexed drawings where.

DETAILED DESCRIPTION OF THE PREFERRED EMBODIMENTS

Figure 1:
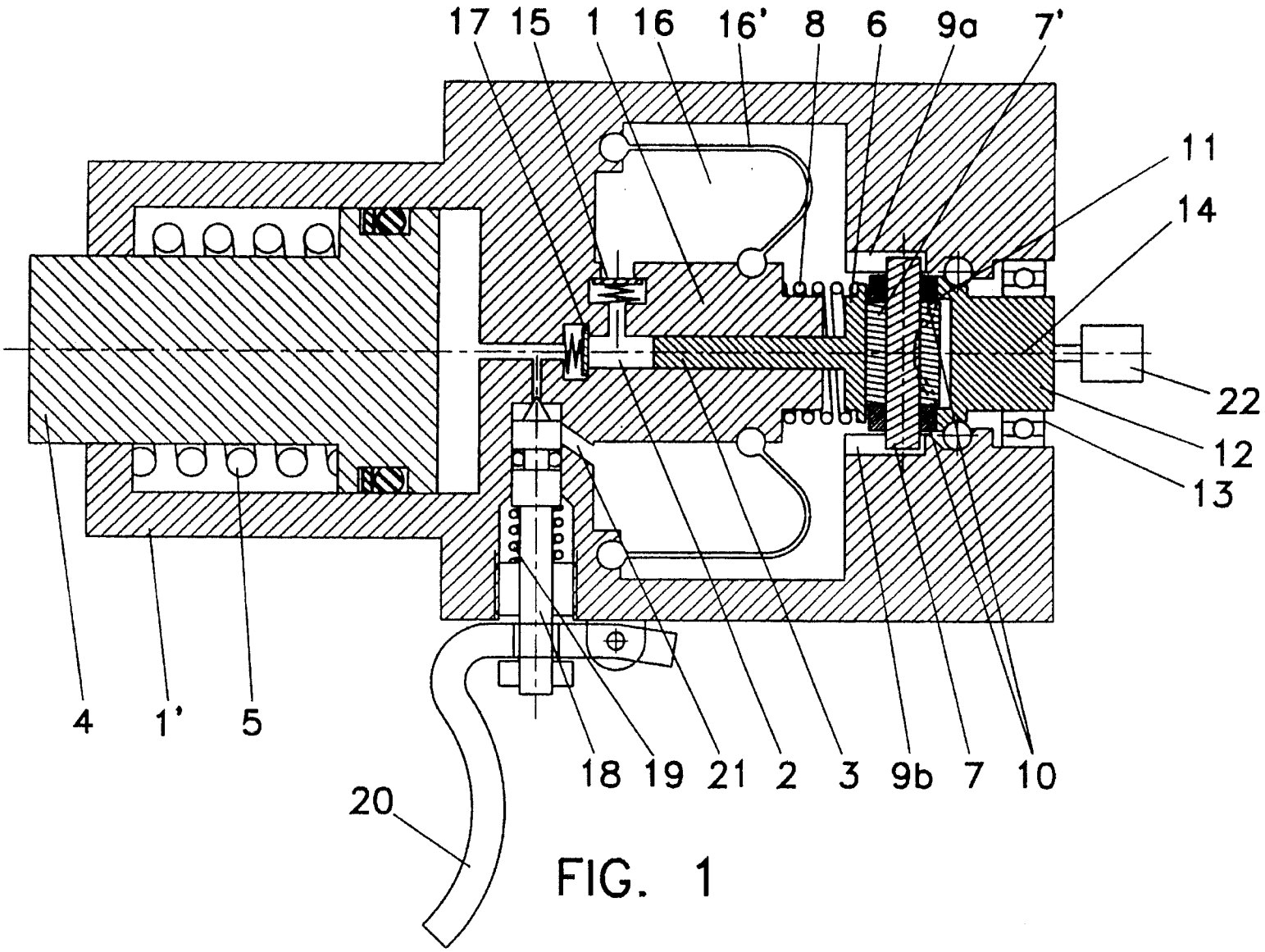
FIG. 1 shows a simplified longitudinal section of a pump according to the invention, provided to activate a hydraulic jack.

These schematic and simplified figures show a pump equipped with a body 1 forming a hollow cylinder 2 for a pump piston 3.

Here, in addition, body 1 simultaneously constitutes, in a single element, a body 1' for a hydraulic jack equipped with a piston 4 arranged to slide into the body 1', and which is biased by a spring 5 working under compression.

Pump piston 3, in the form of a needle, is slidably mounted longitudinally in cylinder 2. It comprises a foot 6, of a single element or not, which is in contact with or affixed to a transverse bar 7 (here by means of a sleeve 7' which will be discussed herein-after) arranged perpendicularly at the piston 3. Foot 6 is biased by a compression spring 8 wedged in body 1, whereas bar 7 is rotationally fixed and translationally guided in the direction of the movement of piston 3 by means of oblong notches *9a,9b* arrange in body 1 (or in a guide element arranged around the body 1) and in which the ends of the bar 7 are displaced. In addition, bar 7 is biased by a double-cam 11 provided with a handle/shank 12, mounted rotationally, for example, in a rolling bearing 13. Here, bar 7 comprises rollers 10 at its end which are wedged by sleeve 7' serving as a spacer.

In fact, foot 6 is in contact with sleeve 7' but as already mentioned, if foot 6 can be affixed to bar 7, sleeve 7' can also be affixed to or be integral with the bar 7.

As shown in the drawings, cam 11 is mounted rotationally about a coaxial axis 14 at the longitudinal axis of piston 3.

Figure 2:
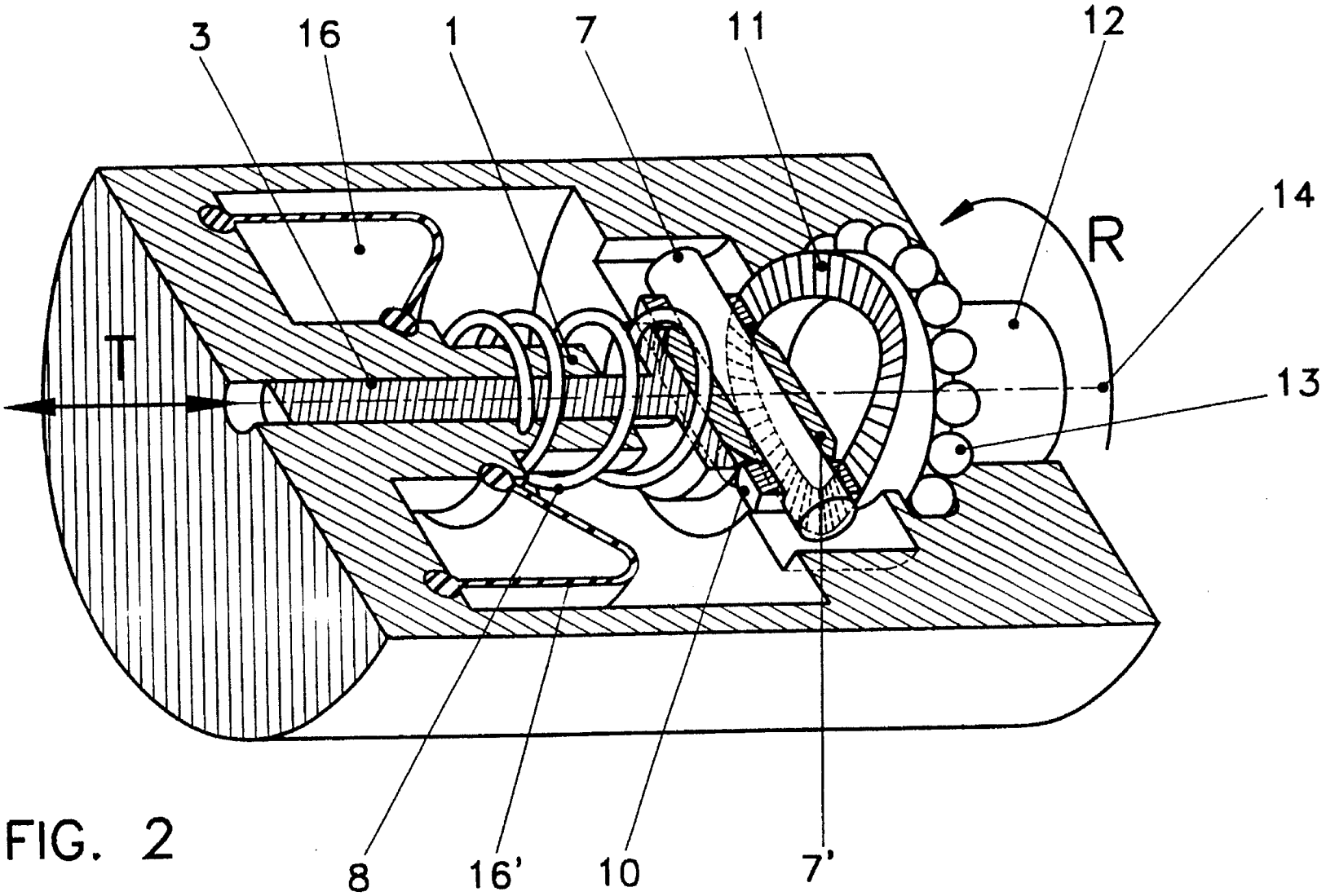
FIG. 2 is a sectional and perspective schematic diagram illustrating the pump of FIG. 1.

The diagram of FIG. 2, which only shows the essential elements or portions thereof that are necessary for a good understanding, clearly shows the special shape of cam 11 and how, by rotating along arrow R, it biases bar 7 and therefore piston 3, by means of rollers 10, to take an alternative rectilinear movement along double-arrow T, i.e., to move to-and-fro, the return movement being ensured by the aforementioned spring 8. Rollers 10 rotate upon contact with cam 11, but it is clear that according to another embodiment not comprising rollers 10 nor sleeve 70', cam 11 slides over bar 7.

The alternative movement of piston 3 in cylinder 2 enables conventional suctioning of a fluid contained in a deformable tank formed by a flexible membrane 16', by means of at least one suction valve 15, to force back the fluid by means of a recoil valve 17 in body 1' of the hydraulic jack.

Hydraulic jack (1',4) enables activation of any means and in particular, a tool, as already mentioned. However, it is obvious that if the jack represented is a pulling jack, one can of course, activate a pulling jack for a corresponding tool, the fluid being displaced towards the other end of the piston and the spring, of course, being reversed.

In a known manner, the device is also provided with a delivery valve 18 retained on its seat by a spring 19.

Possibly, valve 18 can be activated either automatically (calibrated spring) or by maneuvering a trigger-shaped lever 20 so as to control the retraction of piston 4 from the jack while emptying body 1' by a discharge circuit schematized in 21, the fluid then returning towards tank 16.

Handle/shank 12 of cam 11 can be driven in rotation by any means, and especially by an electric motor schematized in 22.

However, it is clear that motor 22 will generally act by means of a pinion or gear system such that its own axis can, of course, be offset.

In addition, according to an interesting arrangement and as shown in the drawings, the deformable tank is annular and surrounds at least a portion of body 1.

Preferably, and yet more specifically, one can see that flexible membrane 16' is fixed imperviously on body 1 (or on or between the fixed or integral portions of the body 1) such that the hydraulic portion is separated from the mechanical portion comprising especially bar 7, cam 11, and the corresponding end of piston 3. If necessary, one can also provide additional and/or complimentary tanks.

The preceding description relates to a preferred embodiment, the double-cam acts on bar 7 with or without rollers 10. However, it is also possible, for example, to envision an embodiment according to which one of the ends of bar 7 would form a pivot whereas the other end, guided as before and provided with or without a roller, would be driven in an oscillating movement by a simple cam while biasing the piston in a to-and-fro movement.

Finally, as already mentioned, the invention can be related to the displacement of a fluid for other applications (elevation of a fluid, decantation . . . ). Indeed, the invention is essentially related to the pump as schematized in FIG. 2.

Although the invention has been described with reference to particular means, materials and embodiments, it is to be understood that the invention is not limited to the particulars disclosed and extends to all equivalents within the scope of the claims.

We claim:

1. Positive displacement vacuum pump, comprising:

a pump body;

a piston positioned in said pump body and comprising a longitudinal axis and a first end, said piston being mounted for actuation by alternative linear movement;

an elastic element biasing said piston in a first direction;

a cam acting on said first end of said piston, said cam being rotatably movable along an axis that is coaxial with said longitudinal axis of said piston to drive said piston in an alternating linear movement; and a transverse bar positioned between said first end of said piston and said cam, said transverse bar comprising a length and being rotationally fixed but translationally guided in the direction of alternative linear movement of said piston; said cam comprising a double surface to equally bias said transverse bar at two positions along the length of the bar.

2. The pump according to claim 1, comprising an electric motor for rotationally driving said cam.

3. The pump according to claim 2, comprising a plurality of rollers positioned between said transverse bar and said cam, so that said rollers rotate upon contact with said cam.

4. The pump according to claim 3, wherein said plurality of rollers comprise two rollers arranged at ends of said transverse bar, and a spacer sleeve positioned therebetween.

5. The pump according to claim 2, wherein said transverse bar directly contacts and slides on said cam.

6. The pump according to claim 1, comprising a rotationally driven shank for driving said cam.

7. The pump according to claim 6, wherein said transverse bar directly contacts and slides on said cam.

8. The pump according to claim 6, comprising an electric motor for rotationally driving said shank.

9. The pump according to claim 6, comprising a plurality of rollers positioned between said transverse bar and said cam, so that said rollers rotate upon contact with said cam.

10. The pump according to claim 9, wherein said plurality of rollers comprise two rollers arranged at ends of said transverse bar, and a spacer sleeve positioned therebetween.

11. The pump according to claim 1, wherein said transverse bar directly contacts and slides on said cam.

12. The pump according to claim 1, comprising a plurality of rollers positioned between said transverse bar and said cam, so that said rollers rotate upon contact with said cam.

13. The pump according to claim 12, wherein said plurality of rollers comprise two rollers arranged at ends of said transverse bar, and a spacer sleeve positioned therebetween.

14. The pump according to claim 1, comprising a deformable tank filled with fluid, with said fluid being displaceable from said tank towards a utilization circuit.

15. The pump according to claim 14, wherein said deformable tank is annular and surrounds at least a portion of said pump body.

16. The pump according to claim 15, wherein said tank comprises a fluid impervious membrane mounted so as to fluid-imperviously separate a hydraulic circuit from a mechanical circuit comprising said transverse bar, said cam and said first end of said piston.

17. The pump according to claim 16, comprising a plurality of rollers positioned between said transverse bar and said cam, so that said rollers rotate upon contact with said cam.

18. The pump according to claim 17, wherein said plurality of rollers comprise two rollers arranged at ends of said transverse bar, and a spacer sleeve positioned therebetween.

19. The pump according to claim 16, wherein said transverse bar directly contacts and slides on said cam.

20. In combination, the pump according to claim 11 with a hydraulic jack.

* * * * *

UNITED STATES PATENT AND TRADEMARK OFFICE

CERTIFICATE OF CORRECTION

PATENT NO. : 5,472,322
DATED : December 5, 1995
INVENTOR(S) : J. HUET et al.

It is certified that error appears in the above-indentified patent and that said Letters Patent is hereby corrected as shown below:

On the title page, item [56], "References Cited", "U.S. PATENT DOCUMENTS", insert ---4,823,588 4/1989 Bussereau et al.---.

On the title page, item [56], "References Cited", "FOREIGN PATENT DOCUMENTS", insert

| | | |
|---|---|---|
| ---89/02532 | 3/1989 | W.I.P.O. |
| 404394 | 8/1934 | Belgium |
| 2563291 | 4/1984 | France---. |

At column 3, line 1, change "70'." to ---7'.---.

Signed and Sealed this

Third Day of September, 1996

Bruce Lehman

*Attest:*

BRUCE LEHMAN

*Attesting Officer*

*Commissioner of Patents and Trademarks*